US010767863B2

(12) United States Patent
Freeman et al.

(10) Patent No.: US 10,767,863 B2
(45) Date of Patent: Sep. 8, 2020

(54) COMBUSTOR TILE WITH MONOLITHIC INSERTS

(71) Applicants: Rolls-Royce North American Technologies Inc., Indianapolis, IN (US); Rolls-Royce Corporation, Indianapolis, IN (US); Rolls-Royce High Temperature Composites Inc., Cypress, CA (US)

(72) Inventors: Ted Joseph Freeman, Danville, IN (US); Bruce E. Varney, Greenwood, IN (US); Andrew Joseph Lazur, Huntington Beach, CA (US)

(73) Assignees: Rolls-Royce North American Technologies, Inc., Indianapolis, IN (US); Rolls-Royce Corporation, Indianapolis, IN (US)

( * ) Notice: Subject to any disclaimer, the term of this patent is extended or adjusted under 35 U.S.C. 154(b) by 602 days.

(21) Appl. No.: 15/217,444

(22) Filed: Jul. 22, 2016

(65) Prior Publication Data

US 2017/0138597 A1 May 18, 2017

Related U.S. Application Data

(60) Provisional application No. 62/195,669, filed on Jul. 22, 2015.

(51) Int. Cl.

| | |
|---|---|
| ***F23R 3/00*** | (2006.01) |
| ***F01D 9/04*** | (2006.01) |
| ***F23M 5/04*** | (2006.01) |

(52) U.S. Cl.

CPC ..... *F23R 3/007* (2013.01); *F01D 9/04* (2013.01); *F23M 5/04* (2013.01); *F05D 2220/32* (2013.01);

(Continued)

(58) Field of Classification Search

CPC .. F23R 3/02; F23R 3/002; F23R 3/007; F23R 3/60; F02C 7/20; F05D 2260/31; F05D 2300/20212; F01D 11/08

See application file for complete search history.

(56) References Cited

U.S. PATENT DOCUMENTS 4,642,024 A * 2/1987 Weidner ..... F01D 11/08 415/116
4,749,029 A * 6/1988 Becker ..... F23R 3/002 165/169

(Continued)

*Primary Examiner* — Jason H Duger
(74) *Attorney, Agent, or Firm* — Faegre Drinker Biddle & Reath LLP

(57) ABSTRACT

An annular assembly for a gas turbine engine and a method of making the annular assembly. The annular assembly comprises a supporting member comprising metal and including a support hole therethrough, and a liner tile made of ceramic matrix composite material. A plurality of the liner tile form an annular liner to shield hot combustion gases produced by the gas turbine engine. The liner tile is disposed adjacent the supporting member. A connecting member comprising ceramic material has a base element and a stem. The base element is embedded in the liner tile during construction of the liner tile to form an integrated structure therewith. A distal end of the stem passes through the support hole and is mated with a retaining member to retain the liner tile adjacent the supporting member.

12 Claims, 4 Drawing Sheets

(52) U.S. Cl.
CPC ..... *F05D 2230/31* (2013.01); *F05D 2240/35* (2013.01); *F05D 2260/31* (2013.01); *F05D 2300/6033* (2013.01); *F23M 2900/05004* (2013.01); *F23R 2900/00017* (2013.01); *F23R 2900/00018* (2013.01)

(56) References Cited

U.S. PATENT DOCUMENTS

| | | | | | |
|---|---|---|---|---|---|
| 4,749,298 | A * | 6/1988 | Bundt | F02K 1/82 165/134.1 |
| 5,034,172 | A | 7/1991 | Vives et al. | |
| 5,160,471 | A | 11/1992 | Vives et al. | |
| 5,323,601 | A * | 6/1994 | Jarrell | F23R 3/002 60/752 |
| 5,624,256 | A * | 4/1997 | Pfeiffer | F23M 5/04 110/336 |
| 5,687,572 | A * | 11/1997 | Schrantz | F23R 3/007 431/352 |
| 5,934,066 | A * | 8/1999 | Schmid | F23R 3/10 60/752 |
| 6,733,235 | B2 | 5/2004 | Alford et al. | |
| 7,043,921 | B2 | 5/2006 | Hadder | |
| 7,052,235 | B2 | 5/2006 | Alford et al. | |
| 7,247,002 | B2 | 7/2007 | Albrecht et al. | |
| 7,799,405 | B1 | 9/2010 | Vance et al. | |
| 8,262,345 | B2 | 9/2012 | Andrew | |
| 2002/0056277 | A1 | 5/2002 | Parry | |
| 2003/0101731 | A1 * | 6/2003 | Burd | F23M 5/02 60/796 |
| 2006/0182971 | A1 | 8/2006 | Merrill et al. | |
| 2008/0134683 | A1 | 6/2008 | Foale | |
| 2008/0145211 | A1 | 6/2008 | Foale | |
| 2008/0256955 | A1 * | 10/2008 | Parkman | F23R 3/002 60/752 |
| 2014/0017074 | A1 * | 1/2014 | Olivier | B29B 11/16 415/182.1 |
| 2014/0272431 | A1 * | 9/2014 | Chamberlain | B32B 38/0008 428/446 |
| 2015/0321382 | A1 * | 11/2015 | Jarmon | F01D 5/00 60/796 |
| 2016/0161121 | A1 * | 6/2016 | Chang | C04B 35/80 60/753 |
| 2016/0265784 | A1 * | 9/2016 | Bangerter | F02C 7/12 |

* cited by examiner

COMBUSTOR TILE WITH MONOLITHIC INSERTS

CROSS-REFERENCE TO RELATED APPLICATIONS

The present application claims the benefit of priority from U.S. Patent Application No. 62/195,669, filed on Jul. 22, 2015, which is incorporated herein by reference in its entirety.

FIELD OF THE DISCLOSURE

The present disclosure relates to ceramic matrix composite tiles and support structures therefor, and more particularly to ceramic matrix composite tiles for gas turbine engines.

BACKGROUND OF THE DISCLOSURE

A gas turbine engine typically includes a compressor, a combustor, and a turbine. The gas turbine engine may also comprise an augmenter or afterburner. The combustor receives compressed air from the compressor and fuel from a fuel injector and includes a combustion chamber where the compressed air and the fuel are mixed and ignited. The combustion chamber may experience temperatures greater than 1,900° F. during the combustion process. Combustion gases flow out of the combustor and cause the turbine to rotate thereby performing work. Combustion reaction products include carbon dioxide ("$CO_2$") and nitrous oxide ("NOx"). The combustion efficiency and amount of these reaction products depend on the combustion temperature.

The combustor includes a liner structured to shield components external of the combustion chamber from the heat produced in the combustion chamber. The liner may be comprised of or coated with insulation materials. Traditional liners comprised metals and alloys. Ceramic matrix composite ("CMC") liners can withstand higher temperatures than metals and alloys, which enable the gas engine turbines to achieve higher efficiencies. In addition to combustors, CMC structures may be used to line any surface of the gas turbine engine in contact with combustion gases, including exhaust liners, augmenter liners, and blade tracks.

The liners are supported by a support structure which is, typically, metallic. Due to the temperature difference between the liner and the support structure, and the forces generated by the products of combustion, the support structure may thermally expand at a different rate than the liner, creating additional structural stresses. These stresses increase in proportion to the temperature of combustion and the power generated therefrom. Therefore, there is a need to provide an improved liner support structure and an improved method of making the improved liner support structure.

SUMMARY OF DISCLOSED EMBODIMENTS

Embodiments of an annular assembly for a gas turbine engine and a method of making same are provided herein. In one embodiment, the annular assembly comprises a supporting member comprising metal and including a support hole therethrough, and a liner tile made of ceramic matrix composite material. The liner tile is disposed adjacent the supporting member. A plurality of the liner tile form an annular liner to shield hot combustion gases produced by the gas turbine engine. A connecting member comprising ceramic material has a base element and a stem. The base element is embedded in the liner tile during construction of the liner tile to form an integrated structure therewith. A distal end of the stem is configured to pass through the support hole of the supporting member. A retaining member is configured to mate with the distal end of the stem to retain the liner tile adjacent the supporting member. In variations thereof, the annular liner comprises one of a combustor liner, an exhaust liner, an augmenter liner, and a blade track, of the gas turbine engine.

In one variation thereof, the ceramic matrix composite material comprises fibers, and the base element is surrounded by the fibers. In another variation thereof, the connecting member is sized and configured to maintain a distance between a supporting member facing side of the liner tile and an internal surface of the supporting member between about 0.030 and 0.090 inches. In one example, a section of the liner tile corresponding to a surface area of the base element protrudes from the supporting member facing side of the liner tile surrounding the base element and contacts the internal surface of the supporting member to maintain the distance. In another example, the stem of the connecting portion comprises a first section connected to and extending from the base element, a second section including the distal portion, and a transition portion therebetween contacting the internal surface of the supporting member to maintain the distance.

In a further variation, the integrated structure comprises at least two connecting members, the supporting member comprises at least two support holes therethrough, and the two support holes are shaped to permit lateral movement of the stems of the at least two connecting members to limit structural stresses caused by thermal expansion of the supporting member and the liner tile caused by the hot combustion gases. In one example, two of the at least two support holes have a short axis and a long axis in their cross-sections. The long axis of one of the two support holes is oriented differently than the long axis of the other of the two support holes to permit movement of the stems radially and axially relative to each other.

In another embodiment set forth herein, a combustor for a gas turbine engine comprises an annular shroud comprising metal and including a support hole therethrough, and a liner tile made of ceramic matrix composite material. A plurality of the liner tile form an annular liner to shield hot combustion gases produced in the combustor. The liner tile is disposed adjacent the annular shroud. A connecting member comprising ceramic material includes a base element and a stem. The base element is embedded in the liner tile during construction of the liner tile to form an integrated structure therewith. A distal end of the stem is configured to pass through the support hole of the annular shroud. A retaining member is configured to mate with the distal end of the stem to retain the liner tile adjacent the annular shroud.

In a further embodiment set forth herein, a method of making an annular assembly for a gas turbine engine comprises laying a first layer of fibers in a tool; positioning a base element of a connecting member on the first layer of fibers; laying a second layer of fibers over the first layer and the base element; infiltrating a ceramic matrix to form a ceramic matrix composite material; and densifying the ceramic matrix composite material to form a liner tile integrated with the base element. The connecting member includes a stem connected to and extending from the base element. The method also comprises inserting a distal end of the stem through a support hole of a supporting member comprising metal; securing a retaining member on the distal end to retain the integrated structure adjacent the supporting member; and repeating the inserting and securing steps to form an annular liner with a plurality of the liner tile for hot combustion gases produced by the gas turbine engine.

Additional embodiments encompass some or all the foregoing features, arranged in any suitable combination. Certain embodiments of the present disclosure may include some, all, or none of the above advantages. One or more other technical advantages may be readily apparent to those skilled in the art from the figures, descriptions, and claims included herein.

The features and advantages of the present disclosure will become more readily appreciable from the following detailed description when taken in conjunction with the accompanying drawings.

Figure 1:
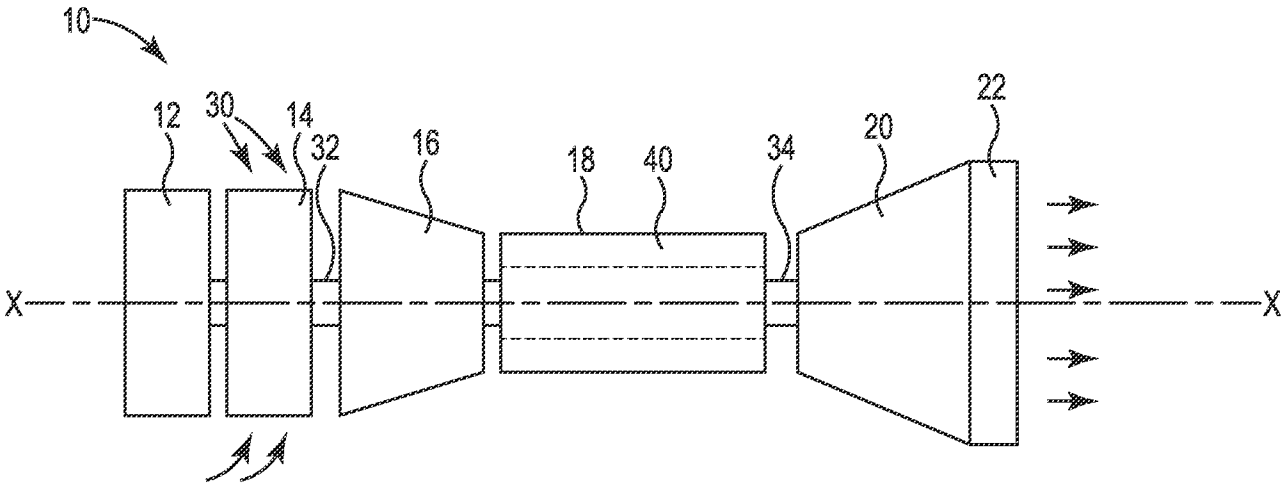
FIG. 1 is a block diagram of an embodiment of a gas turbine engine.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplifications set out herein illustrate embodiments of the disclosure, and such exemplifications are not to be construed as limiting the scope of the claims in any manner.

DETAILED DESCRIPTION

For the purposes of promoting an understanding of the principles of the disclosure, reference will now be made to the embodiments illustrated in the drawings, which are described below. The embodiments disclosed below are not intended to be exhaustive or limit the claims to the precise form disclosed in the following detailed description. Rather, the embodiments are chosen and described so that others skilled in the art may utilize their teachings. It will be understood that no limitation of the scope of the claims is thereby intended unless specifically stated. Except where a contrary intent is expressly stated, terms are used in their singular form for clarity and are intended to include their plural form.

The disclosure relates to CMC tiles, support structures for CMC tiles, methods of supporting CMC tiles, and gas turbine engines including CMC tiles and supporting structures. CMC tiles exhibit good temperature resistance, fracture toughness under mechanical or thermo-mechanical loads, and lower weight than the structures they replace. These characteristics, and the capability to form CMC components in complex shapes, make CMC components suitable for use as tiles of liners in gas turbine engines. The CMC tiles are supported from support structures that comprise metal and have different thermal expansion coefficients, which can cause additional structural stresses at the high temperatures generated by the gas turbine engine. Embedding a support member in the CMC tile provides structural rigidity in a cost-effective process. The support member may be have a thermal expansion coefficient substantially similar to the thermal expansion coefficient of the CMC tile. A support arrangement that permits the CMC tiles to move relative to member of the support arrangement connected to and supporting the CMC tiles can limit the negative effect of operation at high temperatures, thereby enabling operation at even higher temperatures which may increase the efficiency of the gas turbine engine. Other advantages include reduced weight and reduced thermal expansion of the support arrangement.

Figure 2:
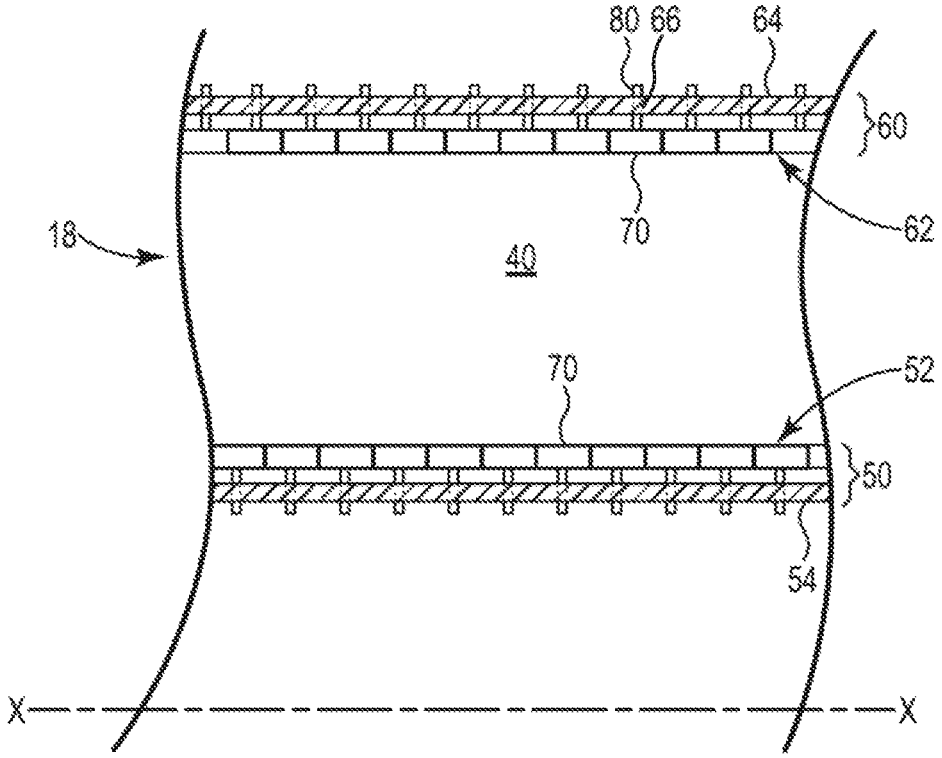
FIG. 2 is a partial cross-sectional view of an embodiment of an annular assembly.

FIG. 1 is a block diagram of a gas turbine engine 10 rotating a load 12 about a principal axis X and comprising, in the direction of air flow, an air intake assembly 14, a compressor assembly 16, a combustor 18 having an annular combustion chamber 40, a turbine assembly 20, and an exhaust assembly 22. In operation, intake air 30 enters the air intake assembly 14, is compressed in the compressor assembly 16, and the compressed air is mixed with fuel and ignited in the combustion chamber 40. A partial cross-sectional view of the combustion chamber 40 is shown in FIG. 2. Pressure generated by combustion of the fuel and compressed air mixture causes one or more turbines (not shown) in the turbine assembly 20, and a turbine shaft 34 connected thereto, to rotate. The load 12 is connected to a load shaft 32 which is coupled to the turbine shaft 34 and rotated by it. Thus, combustion causes the gas turbine engine 10 to work by rotating the load 12. The load 12 may comprise a fan propeller and be positioned within the air intake assembly 14.

Figure 3:
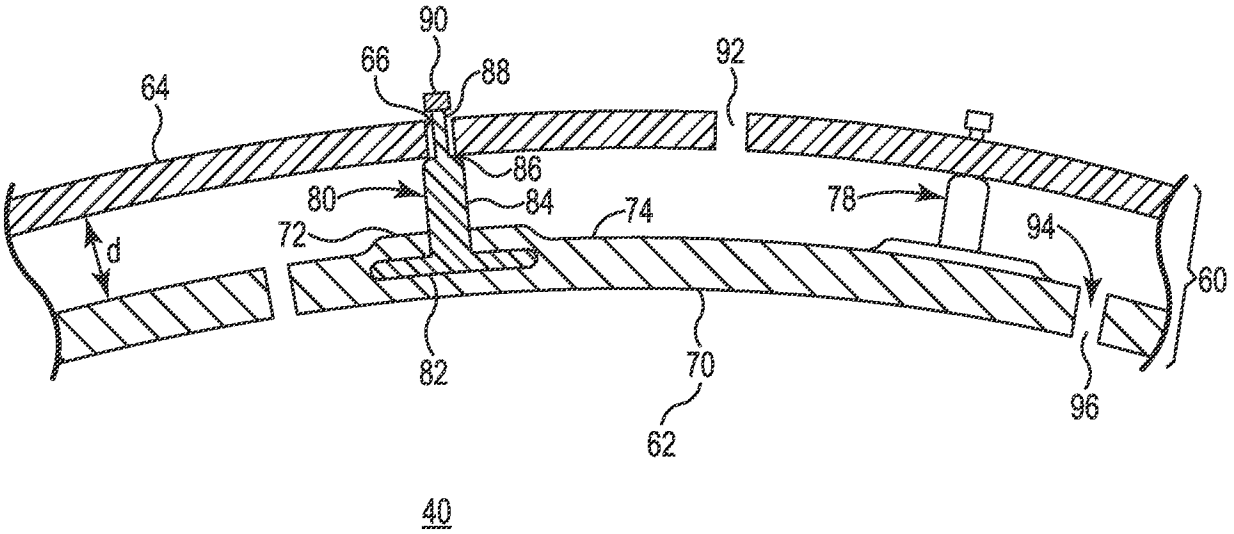
FIG. 3 is an expanded partial cross-sectional view of the annular assembly of FIG. 2.

Referring now to FIG. 2, the combustion chamber 40 is formed by an internal annular assembly 50 and an external annular assembly 60, both assemblies radially spaced from the principal axis X of the gas turbine engine 10. The internal annular assembly 50 comprises an annular liner 52 and an annular shroud or supporting member 54. The external annular assembly 60 comprises an annular liner 62 and an annular shroud or supporting member 64. The annular liners 52,62 comprise discrete segments, or tiles, 70, which are supported from the annular shrouds 54,64 by the connecting members 80. Each tile 70 comprises or is substantially constructed of CMC materials. For example the CMC materials in a tile may comprise between about 50% and 100% of the weight of the tile. More preferably the CMC materials comprise between about 80% and 100% of the weight of the tile. As shown in FIG. 2, the annular shroud 64 has a plurality of support holes 66 corresponding to the plurality of connecting members 80. A distal portion of each connecting member 80 passes through each support hole 66 and is secured to the annular shroud 64 by a retaining member (not shown). An embodiment of a retaining member, denoted by numeral 90, is shown in FIG. 3. The annular liners 52,62 shield the annular shrouds 54,64 from the intense heat generated in the combustion chamber 40. Thus, less cooling air may be required to operate with CMC liners supported as described herein, which may increase the gas turbine engines' efficiency.

Figure 4:
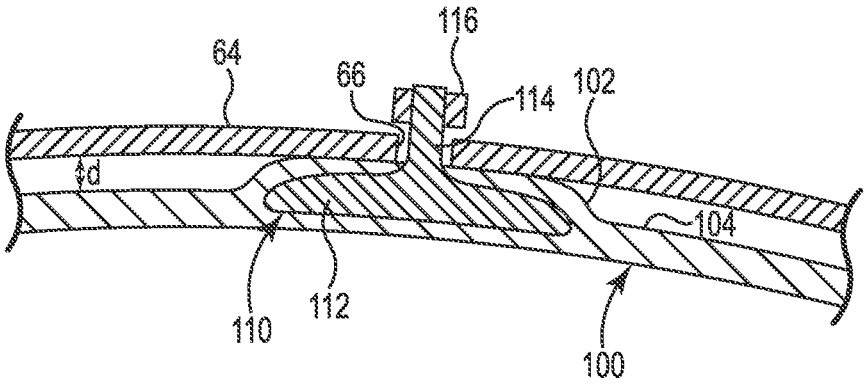
FIG. 4 is an expanded partial cross-sectional view of a portion of the annular assembly of FIG. 4.

For example, when properly supported, CMC tiles can withstand temperatures near 2,200° F. and potentially as high as 2,350° F., where metallic and superalloy liners can only withstand about 1,900° F. Yet in spite of the thermal protection provided by the annular liners 52,62, the annular shrouds 54, 64 expand as the temperatures rise. The coefficient of thermal expansion ("CTE") of metal is about $9.5\times10^{-6}$ while the CTE of a CMC component is about $2.5\times10^{-6}$. The annular shrouds 54,64 comprise metals, thus they may expand nearly four times as much as the CMC tiles. It is therefore advantageous to secure the tiles 70 to the annular shrouds 54,64 in a floating arrangement so that expansion of the annular shrouds 54,64 does not create undue structural stresses on the annular liners 52,62 or the connecting members 80. A partial cross-sectional view of an embodiment of the connecting member 80 is shown in FIG. 3. A partial cross-sectional view of another embodiment of a connecting member, denoted by numeral 110, is shown in FIG. 4. A floating arrangement is discussed with reference to FIG. 5.

Referring to FIG. 3, an expanded axial view of a section of the external annular assembly 60 of the combustion chamber 40 is shown. The internal annular assembly 50 is constructed in a similar manner. The annular shroud 64 includes, in addition to the support holes 66, a plurality of cooling holes 92 configured to receive cooling air 94. The annular liner 62 includes a plurality of cooling passages 96 formed between the tiles 70 to let the cooling air 94 pass therethrough. The cooling air 94 cools the shroud facing, or outer, surface 74 of the tiles 70 and then forms a cooling air layer adjacent the combustion chamber facing, or inner, surface of the tiles 70. As used herein in connection with a tile 70, "inner surface" may be used to refer to the surface facing the hot combustion gases and the "outer surface" may be used to refer to the surface facing the shroud or supporting member. Each tile 70 includes an environmental barrier coating (not shown) to prevent water vapor, another combustion reaction product, from reacting with the surface of the CMC tile thereby preventing surface recession in the CMC tile. Exemplary environmental barrier coatings include terbium disilicate and a combination of a doped rare earth disilicate bond coat and a porous rare earth silicate or barium-strontium-aluminosilicate top coat. In embodiments of the present disclosure the tiles 70 and 110 (discussed with reference to FIGS. 4 and 5) have a length, disposed circumferentially, of between about 3 and 9 inches, a width, disposed longitudinally, of between about 1 and 3 inches, and a thickness, disposed radially, of between about 0.060-0.250 inches. However, the tiles may be smaller or larger, and may be longer axially than circumferentially.

The connecting member 80 comprises a base element 82, a stem including a first section 84 connected to and extending from the base element 82, a second section 88 extending from the first section 84, and a transition portion, or shoulder, 86 therebetween. In the present embodiment, the annular shroud 64 contacts the transition portion 86 and thus the length of the first section 84 defines a separation distance "d" between the annular liner 62 and the annular shroud 64. The separation distance is configured to maximize cooling. In one variation, the separation distance is between about 0.090 and 0.300 inches. The retaining member 90 keeps the second section 88, and the tile 70, in place. Exemplary embodiments of a retaining member include nuts, snap-rings, C-clips, and any known or future developed component configured to mate with a distal end of the stem to retain the connecting member. In embodiments of connecting members the distal end of the stem is threaded, includes a circumferential slot, or otherwise comprises a feature configured to mate with a corresponding retaining member. The base element comprises a length, a width, and a thickness. The length extends circumferentially and the width extends longitudinally. The base element may comprise geometric shapes including squares, rectangles, circles, ellipses, superellipses, and squircles, in each case exhibiting a curvature radius similar to the radius of the liner. The base element may comprise parallel surfaces that define the thickness of the base element. The base element may also comprise an ellipsoid. Preferably the base element is devoid of corners to avoid stress points. Preferably the rectangles and squares have rounded corners.

The connecting members are integrated with the tiles in the process of constructing the tiles. The connecting members may comprise any monolithic ceramic material, green body, reinforced ceramic, or CMC material (either partially or fully densified) that is compatible with the CMC process used to construct the tiles. To construct a tile, fibers are laid in a tool, and at least one connecting member is positioned over the fibers. Exemplary fibers comprise carbon (C), silicon carbide (SiC), alumina ($Al_2O_3$), mullite ($Al_2O_3$—$SiO_2$), and silicon nitride ($Si_3N_4$). Exemplary matrices can comprise the same materials, and free silicone. In one example, a connecting member comprises a SiC/SiC matrix composite. More fibers are then laid over the existing fibers and the base element of the at least one connecting member, trapping the base element between the fibers and forming a protruding section, denoted in FIG. 3 by numeral 72, corresponding to the surface area and thickness of the base element 82 and protruding from the outer or shroud facing surface 74 of the liner tile. The fibers are then infiltrated. Exemplary infiltration processes include melt, slurry, and chemical vapor infiltration. After infiltration the structure is further processed, for example by intensification. The structure prior to intensification will be referred to as a "green body". After intensification, the connecting member is permanently mechanically secured in the CMC composite, forming an integrated structure. The connecting member may bond with the CMC matrix. The connecting member may be embedded in the fibers as a green body or as finally processed, and may be machined as a green body, after infiltration, or after densification of the integrated structure.

More than one connecting member may be integrated with each tile 70. In addition to the connecting member 80, shown in cross-section, a similarly constructed connecting member 78 is shown in FIG. 3, not in cross-section, to illustrate that the connecting member 78 is at a different longitudinal position (into the page) in the tile 70 relative to the connecting member 80. Preferably, between two and seven connecting members 78,80 are integrated with each tile 70, and more preferably three connecting members 78,80 are integrated with each tile 70. However, in a variation of the present embodiment the connecting member includes one base element and at least two spaced-apart stems connected thereto and extending therefrom, the at least two stems passing through two supporting holes in the annular shroud.

Figure 5:
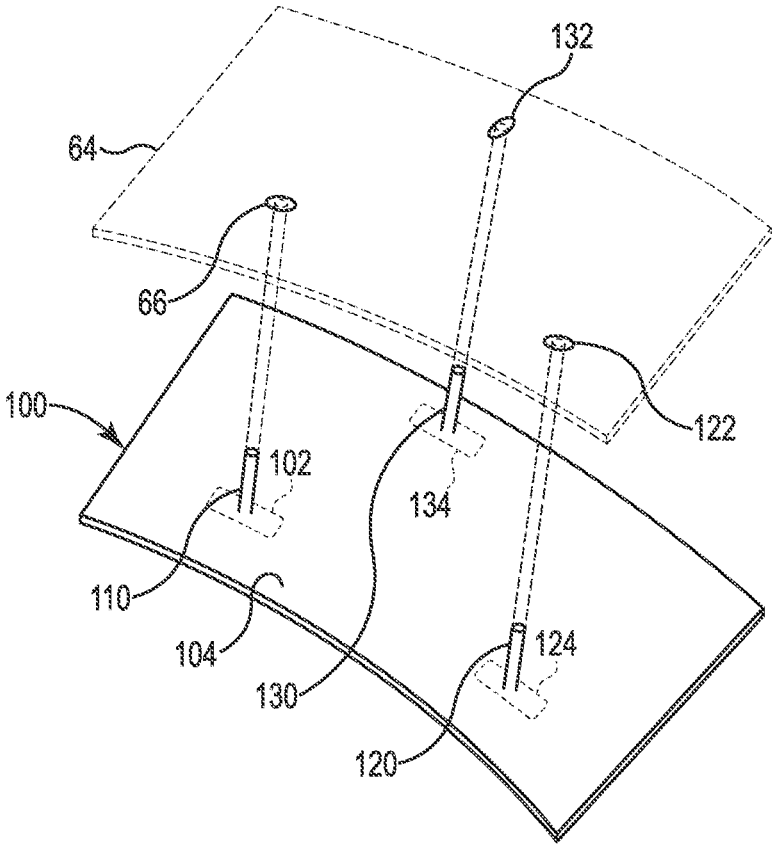
FIG. 5 is a perspective view of a portion of the annular assembly of FIG. 4

FIGS. 4 and 5, sectional and perspective views of a portion of an external annular assembly comprising the annular shroud 64 and embodiments of an annular liner including a CMC tile, illustratively tile 100, having an outer surface 104 facing the annular shroud 64. As shown in FIG. 4, the tile 100 is integrated with a connecting member 110 having a base element 112, and a stem 114, which is secured to the annular shroud 64 by a retaining member 116. Retaining member 116 is similar to a retaining member 90 and serves the same function. A protruding section 102 of the tile 110 contacts the inner surface of the annular shroud 64 defining the distance d therebetween. The thickness of the base element 112 may be structured to control the distance d. The thickness may be substantially uniform, as shown in FIG. 4, or may vary in a uniform manner, for example by decreasing uniformly between the stem 114 and the periphery of the base element 112. The thickness may also vary in a non-uniform manner, providing on the tile's surface a thick protruding area, a thin protruding area, and a transition therebetween, the thick protruding area defining the distance d. Preferably the thick protruding area surrounds the stem 114.

FIG. 5 is a perspective view of the tile 100 and a portion of the annular shroud 64 before the tile 100 is secured thereto illustrating an exemplary floating arrangement. As used herein, a floating arrangement means a support structure in which a CMC tile has at least one degree of freedom to move relative to a supporting member to which it is attached. Preferably the floating arrangement provides axial and circumferential freedom of movement. Generally, freedom of movement is provided when one of two support holes has a larger cross-section than the other of two support holes. The larger cross-section may be provided by a larger diameter support hole or a larger axis of an ovoid-shaped support hole. In this embodiment, the tile 100 includes three connecting members denoted by numerals 110, 120, and 130. The connecting members are identical but denoted by different numerals to denote exemplary positioning of the connecting members on the tile, wherein the connecting members 110 and 120 are aligned on a common plane normal to the principal axis X and the connecting member 130 is on a plane spaced apart from the common plane. Protruding sections 102, 124, and 134 are formed by the base elements of the connecting members 110, 120 and 130, and represent base elements with rounded rectangular shapes, wherein the long axes of the rectangles are oriented circumferentially. The portion of the annular shroud 64 includes three support holes denoted by numerals 66, 122, and 132. In the present embodiment, each of the support holes 66, 122, and 132 has a long axis and a short axis. In one example, each of the support apertures 66, 122, and 132 comprise a slot with circumferential ends, the short axis of the slot is about 0.270 inches, and the long axis is about 0.300 inches. In the present embodiment the distal end of the stem is cylindrical, thereby providing at least 0.030 inches of potential movement of the tile relative to the supporting member. The long axes of the support apertures 66,122 are oriented along the circumference of the annular shroud 64 thereby enabling relative circumferential expansion or contraction of the annular shroud 64 (relative to the annular liner) without creating stress concentrations. The long axis of the support aperture 132 is oriented longitudinally thereby enabling relative longitudinal expansion or contraction of the annular shroud 64 (relative to the annular liner) without creating stress concentrations. In one variation of the present embodiment, a tile is supported by at least two stems, one of the at least two corresponding supporting holes is cylindrical, and the other of the at least two supporting holes is longer than it is wide. In another variation of the present embodiment, a tile is supported by at least two stems, both of the at least two corresponding supporting holes are cylindrical but one has a larger diameter than the other, the larger supporting hole enabling the tile to pivot about the first supporting hole.

Other variations of the disclosed embodiments may be implemented to improve upon known assemblies. For example the distance d between the supporting member and the tile may be constant or may vary. In one embodiment, a liner tile is supported by upstream and downstream supporting members (the terms "upstream" and "downstream" corresponding to the direction of air flow from upstream to downstream) and the length of the stem of the upstream connecting member is shorter than the stem of the downstream connecting member such that tiles are axially angled relative to the surface of the shroud. In another embodiment, the liner tile comprises a blade track segment, and the supporting member supporting the liner tile is connected to an annular blade track carrier of the gas turbine engine. The liner tile is supported by the supporting member as described hereinabove and the supporting member is connected to the annular blade track carrier in any manner know to a person of skill in the art of gas turbines.

While the invention herein disclosed has been described as having exemplary designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A combustor for a gas turbine engine, the combustor comprising:

an annular shroud comprising metal, the annular shroud defining an inward surface and including a first support hole and a second support hole therethough;

a liner the made of ceramic matrix composite material, the liner tile having a first section and a protruding section protruding from the first section, an outer surface of the liner tile spaced from the inward surface along the first section and contacting the inward surface in the protruding section, the liner tile is one of a plurality of liner tiles forming an annular liner to shield hot combustion gases produced in the combustor, the liner tile disposed adjacent the annular shroud;

a first connecting member comprising ceramic material and having a first base element and a first stem, the first base element embedded in, and entirely surrounded by, the ceramic matrix composite material within the protruding section of the liner tile during construction of the liner tile to form an integrated structure with the liner tile and the first connecting member, a distal end of the first stem configured to pass through the first support hole of an annular shroud;

a second connecting member comprising the ceramic material and having a second base element and a second stem, the second base element embedded in, and entirely surrounded by, the ceramic matrix composite material of the liner tile, the first connecting member and the second connecting member, a distal end of the second stem configured to pass through the second support hole of the annular shroud; and a retaining member configured to mate with the distal end of the first stem to retain the liner tile adjacent the annular shroud, wherein the first and second support holes are shaped to permit lateral movement of the first and second stems of the first and second stems in use to limit structural stresses caused by thermal expansion of the annular shroud and the liner tile caused by the hot combustion gases, and wherein in a respective cross-sectional plane the first and second support hole each have a short axis and a long axis, the long axis of the first support hole oriented differently than the long axis of the second support hole to permit movement of the first and second stems radially and axially relative to each other.

2. The combustor of claim 1, wherein the first connecting member comprises between 50% and 100% by weight of ceramic material.

3. The combustor of claim 2, wherein the first connecting member comprises between 80% and 100% by weight of ceramic material.

4. An annular assembly for a gas turbine engine, the annular assembly comprising:

a supporting member forming an annular shroud comprising metal, the supporting member defining an inward surface and including a first support hole and a second support hole therethrough;

a liner the made of ceramic matrix composite material, the liner the having a first section and a protuding section protuding from the first section, an outer surface of the liner tile spaced from the inward surface along the first section and contacting the inward surface in the protruding section, the liner tile is one of a plurality of liner tiles forming an annular liner to shield hot combustion gases produced by the gas turbine engine, the liner the disposed adjacent the supporting member;

a first connecting member comprising ceramic material and having a first base element and a first stem, the first base element embedded in, and entirely surrounded by, the ceramic matrix composite material within the protruding section of the liner the during construction of the liner file to form an integrated structure with the liner the and the first connecting member, a distal end of the first stern configured to pass through the first support hole of the supporting member;

a second connecting member comprising the ceramic material and having a second base element and a second stem, the second base element embedded in, and entirely surrounded by, the ceramic matrix composite material of the liner the during construction of the liner tile to form the integrated structure with the liner tile, the first connecting member and the second connecting member, a distal end of the second stem configured to pass through the second support hole of the annular shroud; and a retaining member configured to mate with the distal end of the first stem to retain the liner the adjacent the supporting member, wherein the first and second support holes are shaped to permit lateral movement of the first and second stems to limit structural stresses caused by thermal expansion of the supporting member and the liner the caused by the hot combustion gases, and wherein in a respective cross-sectional plane the first and second support holes each have a short axis and a long axis, the long axis of the first support hole oriented differently than the long axis of the second support hole to permit movement of the first and second stems radially and axially relative to each other.

5. The annular assembly of claim 4, wherein the annular liner is positioned in one of a combustion chamber, a turbine assembly, and an exhaust assembly, of the gas turbine engine.

6. An annular assembly as in claim 4, wherein the first connecting member is sized and configured to maintain the outer surface of the liner tile spaced from the inward surface along the first section at a distance.

7. An annular assembly as in claim 6, wherein a thickness of the first base element of the first connecting member is structured to control the distance.

8. An annular assembly as in claim 6, wherein a thickness of the first base element of the first connecting member is structured to control the distance, wherein the thickness is variable.

9. An annular assembly as in claim 4, wherein the long axis of the first support hole is oriented along a circumference of the annular shroud.

10. An annular assembly as in claim 4, wherein the liner tile comprises a blade track segment, and the supporting member is connected to an annular blade track carrier of the gas turbine engine.

11. A method of making an annular assembly for a gas turbine engine, the method comprising:

laying a first layer of fibers in a tool;

positioning a first base element of a first connecting member on the first layer of fibers, the first connecting member comprising ceramic material and including a first stem connected to and extending from the first base element;

positioning a second base element of a second connecting member on the first layer of fibers, the second connecting member comprising the ceramic material and including a second stem connected to and extending from the second base element;

laying a second layer of fibers over the first layer, the first base element, and the second base element, the second layer of fibers entirely surrounding the first base element and the second base element;

infiltrating the first layer of fibers and the second layer of fibers with a ceramic matrix to form a ceramic matrix composite material;

densifying the ceramic matrix composite material to form an integrated structure comprising a liner tile integrated with the first base element of the first connecting member and the second base element of the second connecting member, the liner tile having a first section and a protruding section protruding from the first section, the first base element embedded in, and entirely surrounded by, the ceramic matrix composite material within the protruding section of the liner tile;

inserting a distal end of the first stem through a first support hole of a supporting member comprising metal, the supporting member forming an annular shroud and defining an inward surface and;

securing a retaining member on the distal end of the stem to retain the integrated structure adjacent the supporting member, an outer surface of the liner tile being spaced from the inward surface along the first section and contacting the inward surface in the protruding section; and forming an annular liner with a plurality of liner tiles for hot combustion gases produced by the gas turbine engine, the liner tile being one of the plurality of liner tiles wherein the first and second support holes are shaped to permit lateral movement of the first and second stems to limit structural stresses caused by thermal expansion of the annular liner during operation of the gas turbine engine, and wherein in a respective cross-sectional plane the first and second support holes have a short axis and a long axis, the long axis of the first support hole oriented differently than the long axis of the second support hole to permit movement of the first and second stems radially and axially relative to each other.

12. The method of claim 11, wherein the annular liner is positioned in one of a combustion chamber, a turbine assembly, and an exhaust assembly, of the gas turbine engine.

* * * * *